US006749125B1

(12) United States Patent
Carson et al.

(10) Patent No.: US 6,749,125 B1
(45) Date of Patent: Jun. 15, 2004

(54) CENTRAL AIR CONDITIONING, COOLING AND WHOLE-HOUSE VENTILATION SYSTEM

(76) Inventors: Jonathan Carson, 234 Acacia Walk, Lake Wales, FL (US) 33898; William Carson, 3524 Twisted Oak Ct., Lake Wales, FL (US) 33898

( * ) Notice: Subject to any disclaimer, the term of this patent is extended or adjusted under 35 U.S.C. 154(b) by 0 days.

(21) Appl. No.: 10/382,458

(22) Filed: Mar. 6, 2003

Related U.S. Application Data

(60) Provisional application No. 60/362,488, filed on Mar. 8, 2002.

(51) Int. Cl.[7] ..... F24F 7/08
(52) U.S. Cl. ..... 236/49.3; 454/236; 165/248
(58) Field of Search ..... 236/49.3; 165/248, 165/249; 450/236

(56) References Cited

U.S. PATENT DOCUMENTS 4,044,947 A * 8/1977 Spethmann ..... 236/13
4,062,400 A * 12/1977 Horowitz ..... 165/248
4,118,209 A * 10/1978 Exler et al. ..... 62/176.5
4,293,027 A * 10/1981 Tepe et al. ..... 165/250
4,477,020 A * 10/1984 Makara ..... 236/49.3
4,479,604 A * 10/1984 Didner ..... 236/49.3
5,791,408 A * 8/1998 Seem ..... 165/250
6,071,189 A * 6/2000 Blalock ..... 454/236
6,126,540 A * 10/2000 Janu et al. ..... 454/229

* cited by examiner

*Primary Examiner*—William E. Tapolcai

(57) ABSTRACT

A central air conditioning and ventilating system has an exterior air intake duct and a plurality of dampers for opening and closing air ducts. One damper is positioned in the exterior air intake duct and a second damper is positioned in the interior of a return air duct and a third damper is positioned in the interior return air duct escape air duct. The first damper can be opened while the second damper is closed and a third damper opened to convert the air conditioning system to a whole house ventilation system.

17 Claims, 2 Drawing Sheets

CENTRAL AIR CONDITIONING, COOLING AND WHOLE-HOUSE VENTILATION SYSTEM

This application claims the benefit of Provisional application Ser. No. 60/362,488, filed Mar. 8, 2000.

BACKGROUND OF THE INVENTION

Indoor air pollution has now become a major health concern, according to recent EPA studies that have reported that indoor air can be over 10 times more polluted than outdoor air. Additionally, home energy costs for heating and cooling already average nearly one-half of total energy costs for dwellings, with such costs headed higher due to recent price increases. This calls for a simple and effective way to ventilate existing tightly built homes or small business so that breathing air can be exchanged on a scheduled basis by bringing outdoor air to flush out stale inside air and where outside air can be used to help heat or cool the interior whenever favorable outside air is available instead of artificially conditioning the same interior air over and over.

The most practical way to accomplish this ventilation process is to use the existing "central air conditioning" system as much as possible, to pull in and distribute fresh air through the existing air duct delivery outlets and to use the existing air return inlets to transfer the stale interior air out of the interior spaces instead of just re-circulating it, as occurs with normal operation of the conventional central air system.

The addition of mechanical and control components to an existing system allows a conventional central air unit to selectively operate in this way. The new system can be activated both manually for a desired period of operation and automatically to sense and use outdoor air to assist in heating or cooling when possible and to schedule user-desired indoor air change frequency and volumes of fresh air inputs at the most efficient and effective time periods.

The new ventilation method is active rather than passive, as in opening windows. Even opened windows have negative consequences and are not very effective for changing interior air. Open windows require routine manual operations by the home owner, allow dust, dirt and even rain in and, if not closely monitored, invite intruders. Open windows also defeat many security systems.

Outside air can be "blended" into the recirculated interior air by connecting an opening in the duct system to outside air. That is, in a sense, just putting an "air leak" in an existing home that has been built air-tight to lower the heating and cooling expenses is not very effective in actually flushing out the stale interior air and replacing it in a short time with fresh outside air. In cold climates, such blend units are often "heat exchangers" in that they have heat transfer surfaces extending from the heated outlet air over into the incoming cold outside air in order to pass some of the interior heated air energy over to the incoming unheated air. These units are relatively expensive and are not very efficient in the more moderate climates with less extremes of cold outdoor temperatures. Blending in fresh air can only dilute contaminated air, not remove it, especially if new pollutants are being introduced from the same inside sources.

The so-called "whole house exhaust fans" that were frequently used before central air systems became routine were and can be more effective in changing the inside air by drawing in larger amounts of fresh air through opened windows while pulling stale interior air out through a wall or attic fan discharge vent. Since the air tends to flow from the open window directly to the fan outlet, however, "dead" areas of stale air continued to exist. Such fans are rare these days since they are noisy in operation, are difficult to seal and tend to leak, and require the manual opening and closing of windows to operate which lets in unfiltered air containing dust and dirt. Opened windows also can be of a security threat in that they offer an invitation to intruders and also defeat security systems.

SUMMARY OF THE INVENTION

A central air conditioning and ventilating system has a central air conditioning system in a building having a central air handler having a blower and a heat exchanger therein and a plurality of ducts coupled to the central air handler for receiving forced air therethrough from the blower for distribution to a plurality of areas in the building. A central air conditioning system also has an outside condenser unit coupled to the central air handler heat exchanger and at least one interior return air duct. An exterior air intake duct is coupled between the exterior of a building and the central air handler. Improvements include a first damper positioned in the exterior air intake duct having an open position for opening the duct to the exterior air and a closed position for blocking exterior air from reaching the central air handler. A second damper is positioned in the interior of the return air duct and has an open position allowing interior air to pass therethrough to the air handler and a closed position blocking the interior air from passing through the interior return air duct and a third damper is positioned in the interior return air duct escape air duct and has a closed position for blocking the escape of air from the interior return air duct and an open position, opening said return air duct for venting said return air from a building. The first damper can be opened while the second damper is closed and a third damper opened to convert the air conditioning system to a whole house ventilation system.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
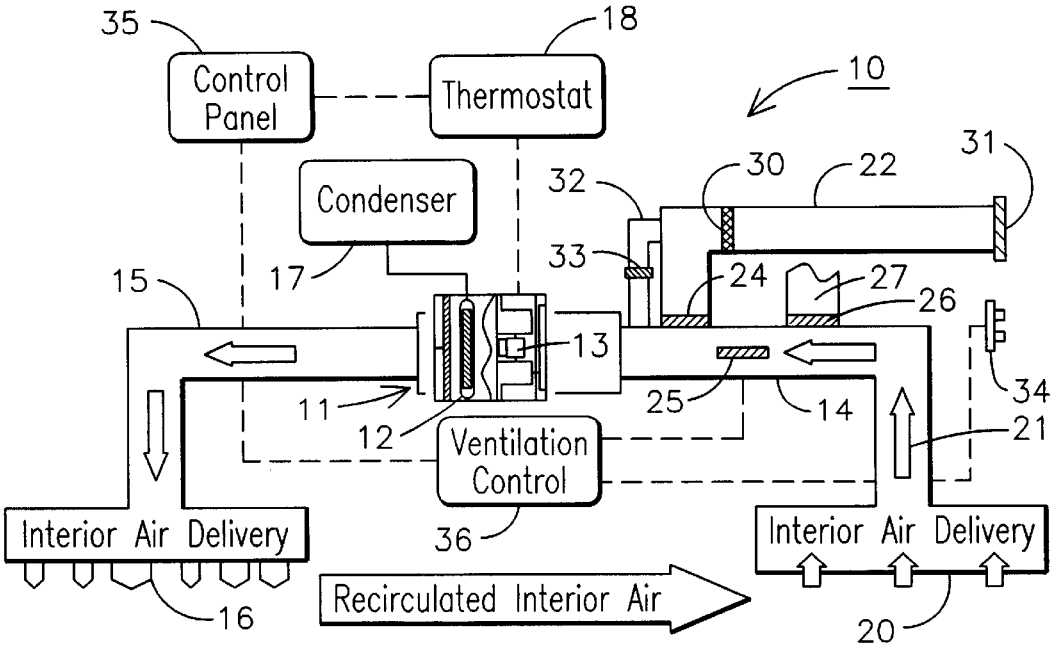
FIG. 1 is a block diagram of a central air conditioning and ventilation system of the present invention in a non-ventilating operating mode.
Figure 2:
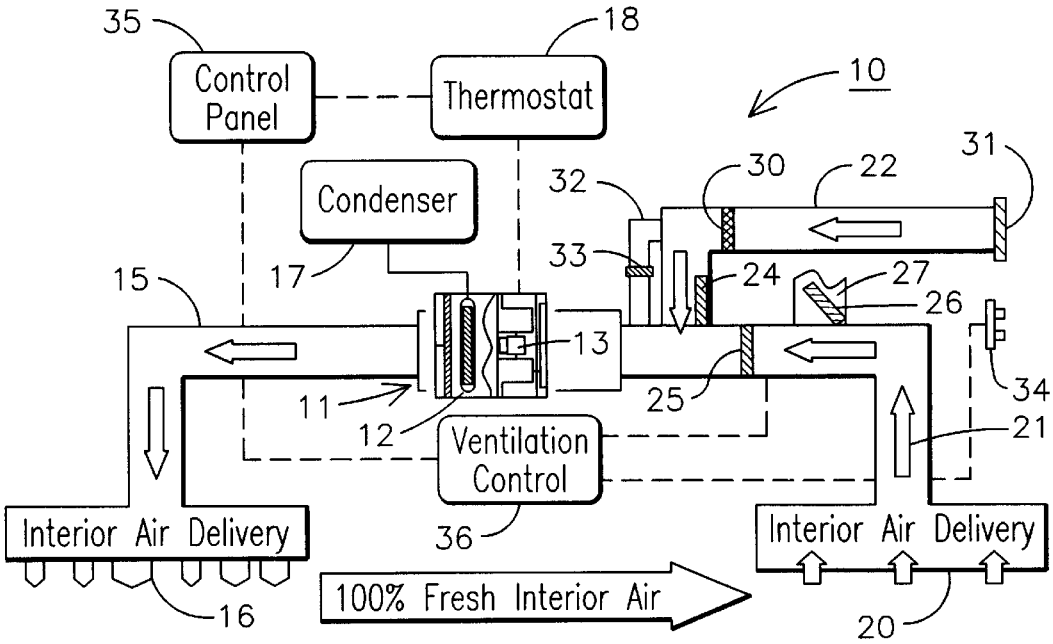
FIG. 2 is a block diagram of the central air and ventilation system of FIG. 1 in a ventilation operating mode.

Referring to FIGS. 1 and 2 of the drawings, a central air conditioning system for cooling a building has been modified to provide a ventilation operating mode. The modified central air conditioning system 10 has a central air handler 11 which is positioned within a building and includes a heat exchanger 12 therein and an electric motor operated blower 13 for blowing air received from a return air duct 14 through the heat exchanger 12 where the air can be cooled or heated and out the air conditioning duct 15. The air conditioning duct 15 then delivers the air through a plurality of ducts 16 to vent the air into different areas of a building. An outside condenser unit 17 is connected to the heat exchanger 12 and, if a heat pump is utilized, the condenser 17 can provide for either heating or cooling through the heat exchanger 12 for heating or cooling the air passing therethrough. The temperature is controlled with a thermostat 18. The air return duct 14 can be connected to a plurality of interior air return ducts or can be one grated vent 20 for capturing interior air from within the building for return to the central air handler 11. As shown by the arrows 21, the air normally passes directly from the interior air vent 20 through the air return ducts into the central air handler 11. The system in accordance with the present invention has been modified by adding an exterior air duct 22 connected to an exterior fresh air intake grill 23 for bringing outside fresh air directly into the air return duct 14.

A first motor or solenoid operated damper 24 is placed at the opening between the duct 22 and the duct 14 and would be in a normally closed position, as shown in FIG. 1. The return air duct 14 has been provided with a second motor or solenoid control damper having on and off positions. It is normally in an open position, as shown in FIG. 1, to allow the return air from the interior of the building to pass through directly to the central air handler 11. A third control damper 26 is placed adjacent an opening 27 in the return air duct 14 and opens or closes an exhaust duct 28 which may be connected to the attic of the building or to the exterior of the building or may open directly into the interior of the building. The damper 26 is a counterweighted damper operated by air pressure from the incoming air and is normally in a closed position, as shown in FIG. 1, to allow the return air from the interior of the building to pass directly through the return air duct 14 into the central air handler 11. Damper 26 can also be solenoid or motor operated as desired. The exterior air duct 22 may also be seen as having a filter 30 therein for filtering air being received in the duct 22 through the grill 31 and the fresh air duct 22 can be seen as having a small air bleed duct 32 connecting the fresh air duct 22 to the return air duct 14 by passing the damper 24 when the damper 24 is closed, as shown in FIG. 1. The fresh air bleed duct 32 has a motor or solenoid controlled damper 33 therein which is normally in a closed position, as in FIG. 1, to prevent fresh air from bleeding therein but may be opened when the damper 24 is closed to allow fresh air to bleed from the fresh air duct 22 into the duct 14 and into the central air handler 11. The system is controlled using outside air temperature and humidity sensor 34 and has a control panel 35 connected to a ventilation control circuit 36 which also has a connection with the outside sensors 34 and a connection 37 for connecting to the damper 24 and 25 for automatically changing the dampers from open to closed or from closed to open positions. The control circuit 36 has been interfaced into the air conditioned system controls to operate the air conditioning and ventilation system as one integrated unit for conditioning the air in a building.

As seen in FIG. 1, a normal operating condition would have the damper 24 normally closed with the damper 25 being normally opened and the damper 26, being automatically operated by air pressure, being normally closed so that the air conditioning system acts as a conventional air conditioning or air conditioning and heating system taking return air from the interior of the building and feeding it back into the central air handler for distribution throughout the building. However, the system also bleeds air through the fresh air bleed 32 by opening the damper 33 while the damper 24 remains closed to allow some fresh air to bleed into the system. Damper 33 can be a counterweighted automatic damper actuated by air pressure or can be solenoid or motor controlled as desired.

As shown in FIG. 2, the damper door 24 has been opened to allow the free-flow of air through the fresh air duct 22 from the exterior of the building while the damper 25 has been closed to block the return air duct from receiving return air from the interior of the building and the damper 26 has been opened to allow interior air to escape into the exhaust duct 28. In the condition of FIG. 2, the controls would have the condenser unit 17 preferably in a non-operating condition, but could engage the air conditioner to condition the incoming fresh air to maintain desired inside comfort levels if needed so that there would be no cooling or heating provided to the heat exchanger coils 11 and with blower 13 operating, the central air conditioning system is converted to a central air ventilation system ventilating with exterior air.

Figure 3:
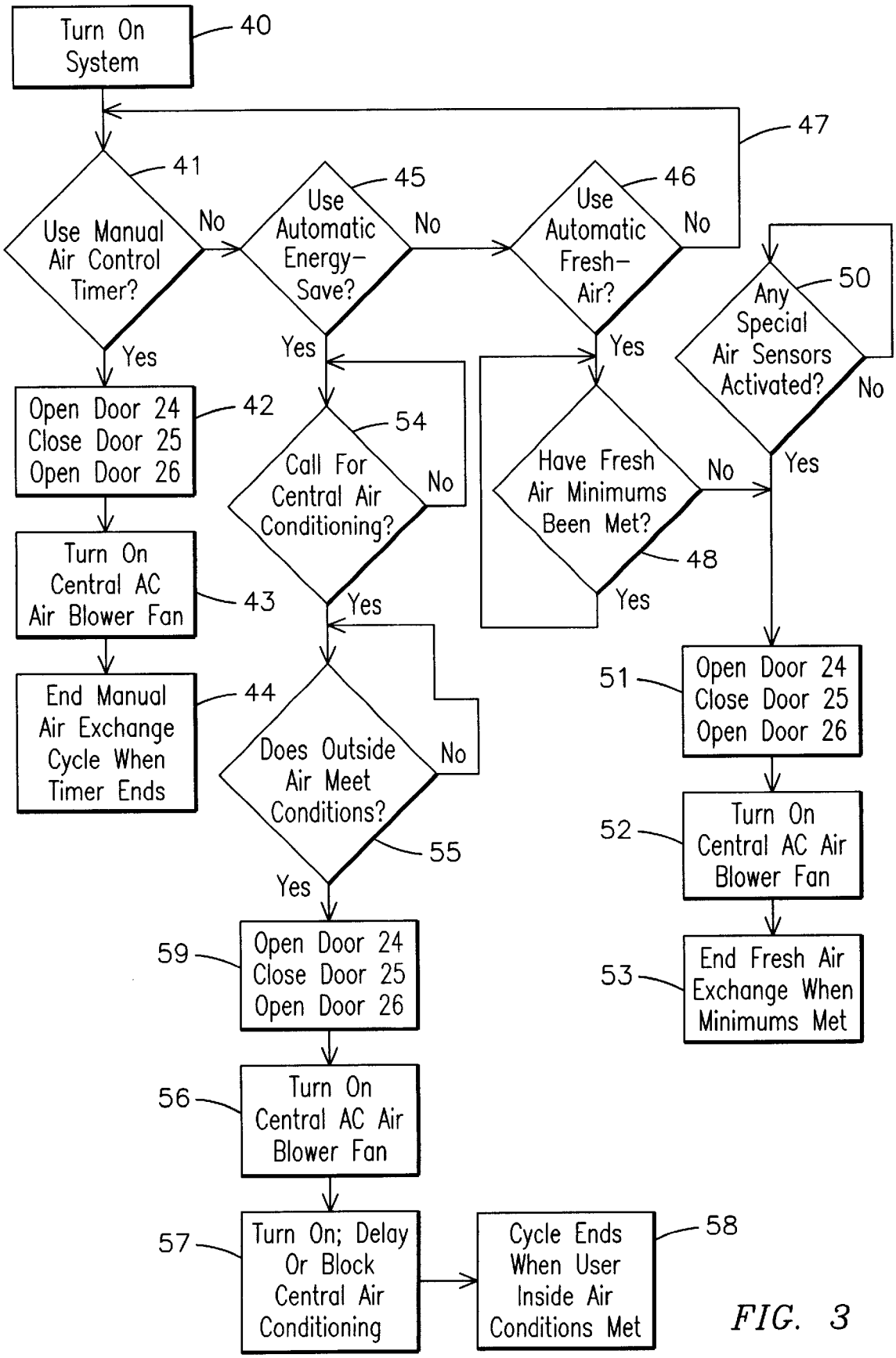
FIG. 3 is a flow diagram of the control process for the central air conditioning and ventilation system of FIGS. 1 and 2.

Turning now to FIG. 3, a flow diagram of the control process is illustrated. The process can be controlled by a central CPU placed in the ventilation control panel 35 or ventilation control components 36 to control the operation of the dampers 24 and 25 (as well as 26 and 33, if desired) responsive to the sensing of the outside temperature and humidity with a sensor 34 and the inside temperature with a thermostat and humidistat 18. The system is turned on at 40 and a manual air control timer 41 can be selected which, if selected, opens damper 24 and closes damper 25 while damper 26 opens automatically from the change in air pressure, as seen in FIG. 2 and in step 42. The central air handler blower is turned on (43) and turned off (44) when the timer ends.

If the manual air control timer 41 is not elected, then the automatic energy-saves step 45 can elect to use automatic fresh air 46 with the feedback 47 and can determine whether fresh air minimums have been met at 48. Once this determination is made, any special air sensors can be activated at 50 which can open doors 24 and close damper 25 and which automatically forces open damper 26 in step 51 while turning on the central air blower fan (52) which is turned off when the minimum air exchange is met (53). The automatic energy save step 45 can also direct a call (54) for central air conditioning and can determine whether the outside air meets conditions (55) and if so, damper 24 can be opened, damper 25 closed, and damper 26 open, as in FIG. 2 of the drawings, to convert the system to a central ventilation system for a building while turning on the central air handler blower 56 for ventilating the building. The air conditioning or heating is turned on, delayed or blocked (57) and the cycle ends (58) when the user inside air conditions are met.

It should be clear at this time that a central air or central heat pump can be conveniently converted to a central ventilation system using outside fresh air for ventilating a whole building when the outside conditions and temperature are such that the air conditioning or heating are not needed and also selectively allows for the bleeding in of exterior air as needed to provide additional fresh air to the central air conditioning system. However, it should be clear that the present invention is not to be construed as limited to the forms shown which are to be considered illustrative rather than restrictive.

We claim:

1. A central air conditioning and ventilating system comprising:

a central air conditioning system in a building having a central air handler having a blower and a heat exchanger therein, said central air conditioning system having a plurality of ducts coupled to said central air handler for receiving forced air therethrough from said blower for distribution to a plurality of areas in said building and a condenser unit coupled to a central air handler heat exchanger and said central air handler having at least one interior return air duct;

an exterior air intake duct coupled between the exterior of said building and said central air handler;

a fresh air bleed duct coupled between said exterior air intake duct and said interior return air duct to bleed outside air into said central air handler;

a first damper positioned in said exterior air intake duct having an open positions for opening said duct to exterior air and a closed position for blocking said exterior air from passing through said exterior air intake duct to said central air handler;

a second damper positioned in said interior return air duct and having an open position allowing interior air to pass therethrough into said air handler and having a closed position blocking said interior air from passing through said interior return air duct;

a third damper positioned in an interior return air duct escape air duct and having a closed position for blocking the escape of air from said interior return air duct and an open position opening said return air duct for venting said return air from a building; and control means for controlling the operation of said first and second dampers between open and closed positions;

whereby said first damper can be opened and said second damper closed and said third damper opened to convert said air conditioning system to a whole house ventilation system.

2. The central air conditioning and ventilating system of claim 1 in which said escape air duct is coupled to the attic of a building to vent air into the attic.

3. The central air conditioning and ventilating system of claim 1 including a fourth damper positioned in said fresh air bleed duct and having an open position for bleeding outside air into said central air handler and a closed position to block outside air from entering the central air handler.

4. The central air conditioning and ventilating system of claim 1 including air treatment means located in said exterior air intake duct.

5. The central air conditioning and ventilating system of claim 1 including building exterior air temperature and humidity sensors.

6. The central air conditioning and ventilating system of claim 5 including a central control unit operatively connected to an existing central air conditioning controls to thereby centrally control the air conditioning and ventilation as an integrated system.

7. The central air conditioning and ventilating system of claim 6 in which said central control unit activates said first, second and third dampers responsive to said exterior air temperature and humidity sensors.

8. The central air conditioning and ventilating system of claim 7 in which said central control unit includes a manually activated controls to manually activate said first, second and third dampers.

9. The central air conditioning and ventilating system of claim 8 in which said manually activated controls includes timing means for timed activating of said first, second and third dampers.

10. The central air conditioning and ventilating system of claim 9 in which said central control unit activates said central air conditioning system to selectively condition the temperature and humidity of incoming air from said exterior air intake duct.

11. The central air conditioning and ventilating system of claim 9 in which said central control unit selectively blocks, delays or activates central air conditioning functions in the central air conditioning system.

12. A process for controlling a central air conditioning and ventilating system comprising the steps:

selecting a central air conditioning system in a building having a central air handler having a blower and a heat exchanger therein, said central air conditioning system having a plurality of ducts coupled to said central air handler for receiving forced air therethrough from said blower for distribution to a plurality of areas in said building and a condenser unit coupled to a central air handler heat exchanger and said central air handler having at least one interior return air duct;

coupling an exterior air intake duct between the exterior of said building and said central air handler, said exterior intake duct having a first damper positioned therein having an open position for opening said duct to exterior air and a closed position for blocking said exterior air from passing through said exterior air intake duct to said central air handler;

adding a second damper positioned in said interior return air duct and having an open position allowing interior air to pass therethrough into said air handler and having a closed position blocking said interior air from passing through said interior return air duct;

adding an escape air duct to said interior return air duct, said escape duct having a third damper positioned therein having a closed position for blocking air from entering said escape duct and an open position opening said escape duct for venting return air from a building; and controlling the operation of said first and second dampers responsive to measurements of temperature on the interior and exterior of said building through a central air ventilation and conditioning controller;

whereby an air conditioning and ventilation system are controlled through a central air ventilation and conditioning controller to work as an integrated unit to condition the air in a building.

13. The process for controlling a central air conditioning and ventilating system in accordance with claim 12 including the step of manually overriding said central air ventilation and conditioning controller for a timed manual operation.

14. The process for controlling a central air conditioning and ventilating system in accordance with claim 12 including the step of coupling a fresh air bleed duct having a fourth damper therein between said exterior air intake duct and said interior return air duct to bleed outside air into said central air handler.

15. The process for controlling a central air conditioning and ventilating system in accordance with claim 12 including the step of adding air treatment means into said exterior air intake duct.

16. The process of controlling a central air conditioning and ventilating system in accordance with claim 12 including the step of comparing building interior and exterior temperature and humidity to determine whether to use interior or exterior air.

17. The process of controlling a central air conditioning and ventilating system in accordance with claim 12 including the step of checking the amount of outside air brought into the building by measuring the length of time said first damper is open during a predetermined time cycle and activating said first damper to change the amount of exterior air to meet a predetermined minimum during said predetermined time cycle.

* * * * *